US005989355A

United States Patent [19]

Brandt et al.

[11] Patent Number: 5,989,355

[45] Date of Patent: Nov. 23, 1999

[54] APPARATUS FOR CLEANING AND TESTING PRECISION COMPONENTS OF HARD DRIVES AND THE LIKE

[75] Inventors: Werner V. Brandt, Santa Barbara; Charles W. Bowers, Torrance, both of Calif.

[73] Assignee: Eco-Snow Systems, Inc., Livermore, Calif.

[21] Appl. No.: 08/805,510

[22] Filed: Feb. 26, 1997

[51] Int. Cl.[6] ..... B08B 6/00

[52] U.S. Cl. ..... 134/6; 134/2; 134/7; 134/10; 134/11; 134/21; 134/40; 134/72; 134/902; 451/38; 451/39; 451/40; 451/78; 451/89

[58] Field of Search ..... 451/38, 39, 40, 451/78, 89; 134/2, 6, 10, 7, 11, 21, 40, 72, 902

[56] References Cited

U.S. PATENT DOCUMENTS

| | | | |
|---|---|---|---|
| 4,027,686 | 6/1977 | Shortes et al. | 134/33 |
| 4,806,171 | 2/1989 | Whitlock et al. | 134/7 |
| 4,817,652 | 4/1989 | Liu et al. | 134/102 |
| 5,125,979 | 6/1992 | Swain et al. | 134/7 |
| 5,209,028 | 5/1993 | McDermott et al. | 51/426 |
| 5,315,793 | 5/1994 | Peterson et al. | 451/89 |
| 5,316,560 | 5/1994 | Krone-Schmidt et al. | 55/385.2 |
| 5,364,472 | 11/1994 | Heyns et al. | 451/78 |
| 5,456,758 | 10/1995 | Menon | 134/33 |
| 5,720,650 | 2/1998 | Mauze et al. | 451/75 |
| 5,766,061 | 6/1998 | Bowers | 451/89 |
| 5,766,368 | 6/1998 | Bowers | 134/6 |
| 5,837,064 | 11/1998 | Bowers | 134/6 |
| 5,853,962 | 12/1998 | Bowers | 430/331 |

*Primary Examiner*—Jill Warden
*Assistant Examiner*—S. Carrillo
*Attorney, Agent, or Firm*—R. Craig Armstrong

[57] ABSTRACT

Apparatus for cleaning, assembling, testing and inspecting contamination sensitive hardware. The apparatus includes an environmental process enclosure having an inner processing chamber, and a carbon dioxide jet spray cleaning system. The enclosure includes a loadlock pass-through having front and rear access doors for providing access to the inner processing chamber. A blower is disposed in the enclosure for circulating purified gas therethrough. A prefilter disposed prior to an inlet of the blower, and a high purity filter and laminar flow screen are disposed in the inner processing chamber. A heater is provided for heating the purified gas and a temperature controller is coupled to the heater for controlling the temperature of the purified gas. A table is disposed in the inner processing chamber upon which contamination sensitive hardware and testing and assembly apparatus may be placed. The carbon dioxide jet spray cleaning system includes a carbon dioxide delivery system for storing liquid carbon dioxide, and a valve assembly coupled to the carbon dioxide tank that is disposed in the inner processing chamber. The valve assembly is coupled to a nozzle and orifice assembly, which produces a spray of gas and solid carbon dioxide that is used to clean the contamination sensitive hardware.

7 Claims, 1 Drawing Sheet

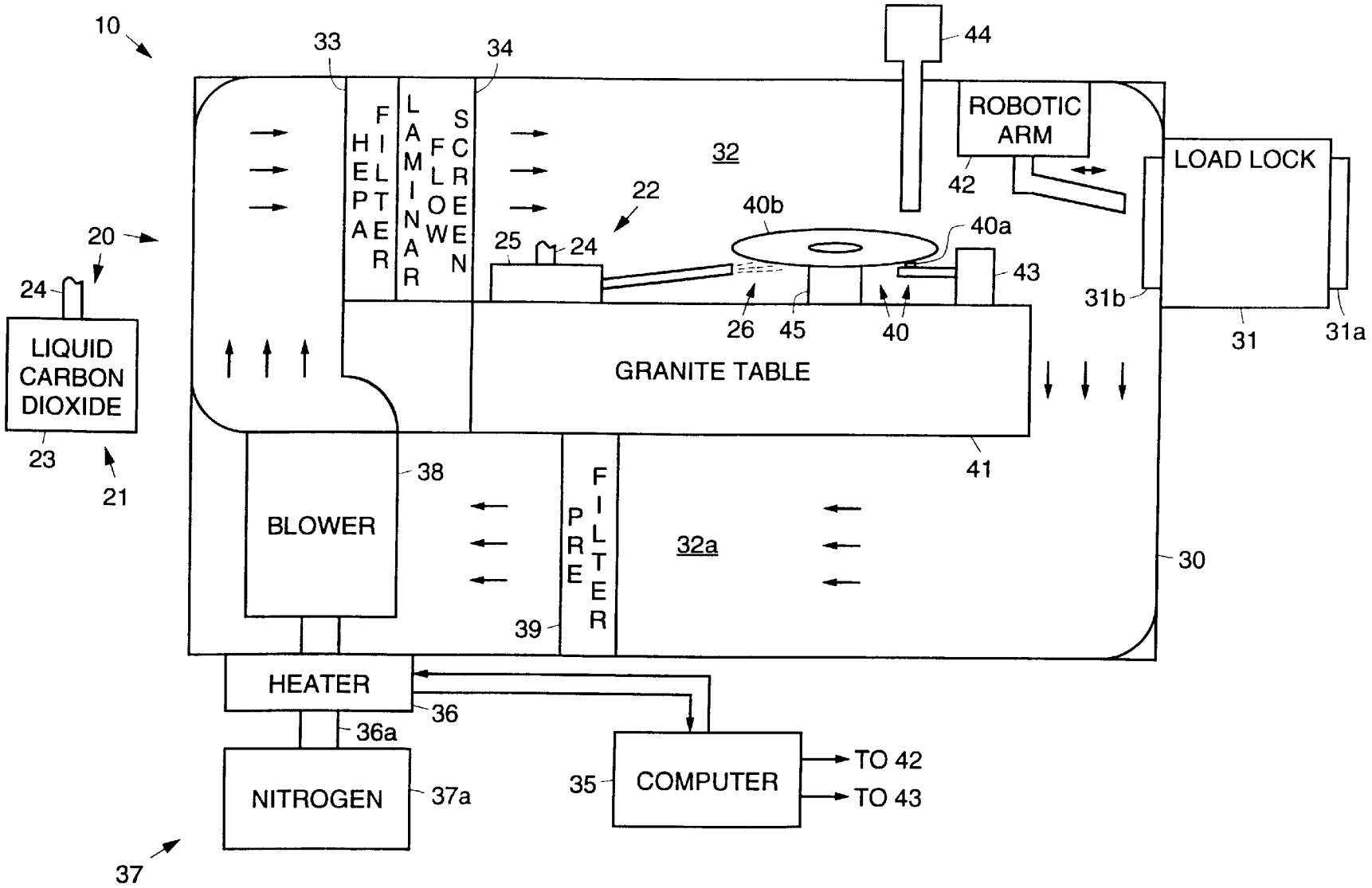
LOAD LOCK
31a
31
30
31b
ROBOTIC ARM
42
44
43
40a
40
41
45
26
40b
32
GRANITE TABLE
32a
22
24
25
34
33
FLAMELESS FAN
FILTER
39
38
BLOWER
HEATER
36
36a
NITROGEN
37a
COMPUTER
35
TO 42
TO 43
10
20
21
LIQUID CARBON DIOXIDE
23
24
37

APPARATUS FOR CLEANING AND TESTING PRECISION COMPONENTS OF HARD DRIVES AND THE LIKE

BACKGROUND

The present invention relates generally to process tooling, and more particularly, to a process tool comprising a carbon dioxide jet spray cleaning system and controlled environment for cleaning, assembling, testing and inspecting precision components, such as those used in optical and hard drives, and the like.

The routine cleaning of precision hardware, such as disks used in computer hard drives, for example, is relatively inefficient, and currently available process tooling is costly. Currently available cleaning processes require unnecessary handling of the hard disks and creates the potential for hardware damage during such handling and transportation.

In commercially available process tools, hardware is removed from the process tool, cleaned, then returned for assembly or test. The transportation of the hardware from the process tool to an exterior cleaning area increases contamination through migration from handling equipment and the shipping container or carrier. The testing of contamination sensitive hardware using currently available process tools typically results in tested hardware that does not meet the original requirements of the product.

A large number of commercially available process tools used for ultra-clean applications have inadequate environment cleanness and control. Currently available process and inspection tools do not provide an environment that is compatible with liquid carbon dioxide jet spray cleaning processes. More particularly, presently available process inspection technology used in process or inspection tools that have self-contained environments, do not supply humidity control, high flow laminar gas recirculation, or liquid carbon dioxide jet spray cleaning capability.

There presently is not a system that provides for an in-situ carbon dioxide jet spray cleaning system used in conjunction with or disposed within an ultra clean environment process tool. Liquid carbon dioxide jet spray cleaning systems and ultra clean environments have separately been developed by the assignee of the present invention as part of its EcoSnow™ product line. However, these two separate technologies have not heretofore been combined to provide process tool for use in jet spray cleaning precision components, such as those used in hard drives, and the like. Furthermore, heretofore, there has been no process tool wherein hardware is cleaned using a combined gas and solid carbon dioxide jet spray while it remains in an ultra clean environment of the process tool.

Accordingly, it is an objective of the present invention to provide for a process tool comprising a carbon dioxide jet spray cleaning system and controlled environment for cleaning, assembling, testing and inspecting precision components.

SUMMARY OF THE INVENTION

To meet the above and other objectives, the present invention provides for a process tool for cleaning, assembling, testing and inspecting precision components. The process tool comprises a carbon dioxide jet spray cleaning system disposed within an ultra clean environmental process enclosure. Critical parameters for an ultra clean process tool include ULPA filtered dry air or inert gas, laminar flow recirculation, humidity control, temperature control, and in-situ jet spray cleaning. The present invention provides these needed capabilities in a single process tool.

The environmental process enclosure houses a precision process or inspection tool used for product testing and/or assembly. The jet spray cleaning system has a carbon dioxide gas delivery system, a valve assembly, and an orifice nozzle. To optimize the cleaning process, the environmental process enclosure has a pre-filter, a high capacity blower, a high flow ultra low particulate air (ULPA) filter, or high efficiency particulate air (HEPA) filter, a ducting system that minimizes or eliminates turbulence, and a dry ionized gas purge system to reduce humidity. The dry, clean environment provided by the environmental process enclosure increases the efficiency of the carbon dioxide jet spray cleaning and eliminates potential recontamination on the surface of the hardware due to condensation. Humidity monitoring equipment is used to give the process operator real time feedback of the percent humidity inside the process tool prior to hardware cleaning and during operation of the system.

The improved process tool environment eliminates problems that arise from hardware transportation, environmental dust, and contamination migration derived from handling fixtures used to transport the hardware, such as disks for hard drives, for example. Using the present invention, the hardware is not removed from the process tool, but may be cleaned, assembled and tested within the environmental process enclosure. The transport of the hardware from the process tool to an exterior cleaning area is thus eliminated, minimizing contamination through migration from handling equipment and the shipping container. Contamination sensitive hardware is thus cleaned, assembled and tested in an ultra clean environment which increases the likelihood that the finished product meets its original specification.

BRIEF DESCRIPTION OF THE DRAWINGS

The various features and advantages of the present invention may be more readily understood with reference to the following detailed description taken in conjunction with the accompanying drawing which illustrates a process tool in accordance with the principles of the present invention, which may be used to clean and test contamination sensitive hardware.

DETAILED DESCRIPTION

Referring to the drawing FIGURE, it illustrates a process tool 10 or system 10 in accordance with the principles of the present invention. The process tool 10 or system 10 comprises a carbon dioxide jet spray cleaning system 20 used with a controlled, ultra pure, environmental process enclosure 30. The environmental process enclosure 30 may be similar to one disclosed in U.S. Pat. No. 5,316,560 entitled "Environment Control Apparatus", which is assigned to the assignee of the present invention, the contents of which are incorporated herein by reference.

The process tool 10 permits in-situ cleaning, assembly, testing and inspecting of contamination sensitive hardware 40, such as optical and hard drives, and pick-up heads used therewith, for example. The carbon dioxide jet spray cleaning system 20 includes a delivery system 21 that is coupled to a valve assembly 25 disposed in the environmental process enclosure 30. The carbon dioxide jet spray delivery system 21 comprises a carbon dioxide tank 23 and tubing 24 coupled between the tank and the valve assembly 25. The valve assembly 25 is coupled to a nozzle and orifice assembly 22. The nozzle and orifice assembly 22 produces a jet spray 26 of gaseous and solid carbon dioxide material (snow) that is used to clean the contamination sensitive hardware 40. The nozzle and orifice assembly 22 may use different nozzle and orifice combinations depending upon the cleaning application. The carbon dioxide snow or spray 26 comprises solid aerosol particles and gas and is sprayed from the nozzle and orifice assembly 22 onto the contamination sensitive hardware 40 to clean it. Momentum transfer between the solid aerosol particles and contaminant particles on sprayed surfaces of the contamination sensitive hardware 40 removes the contaminant particles from the surfaces.

The ultra clean environmental process enclosure 30 has a loadlock pass-through 31 having front and rear access doors 31*a*, 31*b*. A HEPA or ULPA filter 33 and laminar flow screen 34 are disposed in an inner processing chamber 32 of the environmental process enclosure 30. The environmental process enclosure 30 also includes a temperature controller 35 (and which may be provided by a computer 35) that is coupled to a heater 36 that surrounds a nitrogen or dry air inlet filter 36*a*. A high scfm capacity recirculation blower 38 is disposed in the enclosure 30 for circulating air through the enclosure 30, and a nitrogen or dry air (purified gas) purging system 37 including a nitrogen or dry air tank 37*a* is coupled through the inlet filter 36*a* to the blower 38. A prefilter 39 is disposed prior to an inlet of the blower 38 such as in a return duct 32*a* of the enclosure 30. The use of the filter 33, laminar flow screen 34 and prefilter 39 results in purified uncontaminated air containing no more than about 1–2 parts per million of contaminant particles.

A granite table 41 is disposed in the inner processing chamber 32 of the environmental process enclosure 30. The valve assembly 25 and the nozzle and orifice assembly 22 are disposed on the granite table 41 and are arranged so that the spray 26 of gaseous and solid carbon dioxide material is directed onto contamination sensitive hardware 40 that is to be cleaned and tested, such as optical or hard disk drives, or pick-up heads 40*a* for the optical or hard disk drives, for example.

For the purposes of example, the drawing figure illustrates testing and/or inspection of pick-up heads 40*a* used in hard disk drives. A test disk 40*b* is secured to a spindle 45 disposed on the granite table 41. An operator of the system 10 loads the contamination sensitive hardware 40 (pick-up head 40*a*) or other contamination sensitive component 40 into the loadlock pass-through 31. Initial entry into the loadlock 31 is gained by opening the front access door 31*a*. When a pick-up head 40*a* has been placed in the loadlock pass-through 31, the rear door 31*b* is opened, and the retrieval arm 42 enters and picks up the pick-up head 40*a*. The retrieval arm 42 transports the pick-up head 40*a* into the environmental process enclosure 30 for cleaning, and/or testing. In the present example, the pick-up head 40*a* is coupled to a head test assembly 43 which is coupled to the computer 35 that is used to read and write data to the test disk 40*b*, which provides an indication of whether the pick-up head 40*a* is functional. Inspection of the pick-up head 40*a* may be accomplished using a microscope 44, for example, that is used by an operator to observe the pick-up head 40*a* during and/or after testing.

The temperature of the environmental process enclosure 30 is regulated by feedback controls on the heater 36 that surrounds the nitrogen or dry air inlet filter 36*a*. This may be accomplished using the computer 35 or other temperature controller. Gas passing through the environmental process enclosure 30 is filtered three times using the 36*a* inlet filter, the prefilter 39, and the high flow ULPA or HEPA filter 33. Gas is pulled through the high capacity blower 38 and pushed through the ULPA or HEPA filter 33 and laminar flow screen 34 into the inner processing chamber 32. Gas flowing over the component 40 is collected in the return duct 32*a* and is recirculated in the manner illustrated in the drawing figure.

When cleaning is required, the carbon dioxide jet spray system 20 is used to clean the contamination sensitive hardware 40, such as the surface of optical or hard disks, or the pick-up heads 40*a*. The spray 26 of solid and gaseous carbon dioxide flows over and impacts the contamination sensitive hardware 40 and cleans the exposed surfaces. Excess gas from the jet spray 26 and contaminants dislodged from the surface of the contamination sensitive hardware 40 are collected by the ULPA or HEPA filter 33 and are removed by the laminar air flow screen. The high capacity blower 38 supplies clean air flow to the inner processing chamber of the ultra clean environment enclosure 30.

The controlled environment provided within the environmental process enclosure 30 and the cleaning provided by the carbon dioxide jet spray system 20 permits levels of cleanliness necessary for ultra clean manufacturing and testing of contamination sensitive hardware 40. More specifically, the present system 10 provides a contaminant-free environment that is essential for cleaning and testing contamination sensitive hardware 40, such as optical disks and disks for hard drives, for example.

The operator of the process tool 10 can load a piece of hardware 40 into the environmental process enclosure 30 and test, assemble, or inspect the hardware 40 in a normal manner but without additional contamination caused by the process environment. During testing, assembly, or inspection, the contamination sensitive hardware 40 is inside a dry, ULPA or HEPA filtered, static free environment. In-situ cleaning of the contamination sensitive hardware 40 may be carried out at any time required by the particular process. The process tool 10 provides the required cleanness level and in-situ cleaning capability not available in conventionally available process tools.

In addition to the above-described uses of the present invention, the process tool 10 may also be used for wafer inspection and processing, inspection and assembly of hybrid microcircuits, solar power cells, magnetic disk drive components, thin film measurements, flat panel liquid crystal displays, and electronic devices and displays, and the like Thus, a process tool comprising a carbon dioxide jet spray cleaning system and controlled environment for cleaning, assembling, testing and inspecting precision components has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. An apparatus for use with contamination sensitive hardware, said apparatus comprising:

an environmental process enclosure having an inner processing chamber;

a loadlock pass-through communicating with said enclosure, said loadlock pass-through having front and rear access doors for providing access to the inner processing chamber;

a blower and at least one filter disposed in said inner processing chamber for circulating purified gas through the enclosure;

a heater communicating with said enclosure for heating the purified gas;

a temperature controller coupled to the heater for controlling the temperature of the purified gas;

means disposed in the inner processing chamber for supporting said contamination sensitive hardware; and a carbon dioxide jet spray cleaning system disposed in the inner processing chamber for cleaning said contamination sensitive hardware, said cleaning system comprising:

a carbon dioxide delivery system for storing liquid carbon dioxide; and a nozzle and orifice assembly connected to the carbon dioxide delivery system, which nozzle and orifice assembly produces a spray of gas and solid carbon dioxide that is directed towards said contamination sensitive hardware to clean the contamination sensitive hardware;

wherein said contamination sensitive hardware is selected from the group consisting of optical disk drives, hard disk drives, and pick-up heads for optical or hard disk drives, said apparatus further comprising testing means including a test assembly coupled to the contamination sensitive hardware and coupled to a computer to read and write data to a test disk to test the contamination sensitive hardware.

2. The apparatus as recited in claim 1, wherein said at least one filter comprises at least one HEPA filter.

3. The apparatus as recited in claim 1, wherein said means for supporting said contamination sensitive hardware comprises a table within said inner processing chamber.

4. The apparatus as recited in claim 1, wherein said contamination sensitive hardware is an optical disk drive.

5. The apparatus as recited in claim 1, wherein said contamination sensitive hardware is a hard disk drive.

6. The apparatus as recited in claim 1, wherein said contamination sensitive hardware is a pick-up head for an optical or hard disk drive.

7. The apparatus as recited in claim 3, wherein said nozzle and orifice assembly is mounted on said table.

* * * * *